US005741208A

United States Patent [19]

Moak

[11] Patent Number: 5,741,208

[45] Date of Patent: Apr. 21, 1998

[54] ENVIRONMENTAL CONTAINER LINER AND METHOD OF MANUFACTURE

[75] Inventor: Landal B. Moak, Orange, Tex.

[73] Assignee: Industrial Transportation, Inc., Beaumont, Tex.

[21] Appl. No.: 735,449

[22] Filed: Oct. 15, 1996

[51] Int. Cl.[6] ..... B31B 1/26

[52] U.S. Cl. ..... 493/195; 493/254; 493/436

[58] Field of Search ..... 493/196, 197, 493/198, 287, 254, 194, 195, 248, 436, 439, 440

[56] References Cited

U.S. PATENT DOCUMENTS

| | | | |
|---|---|---|---|
| 977,698 | 12/1910 | Barksdale . | |
| 2,215,689 | 9/1940 | Dickson | 206/8 |
| 2,216,527 | 10/1940 | Weiss et al. | 229/14 |
| 2,524,584 | 10/1950 | Zehr | 154/116 |
| 2,574,345 | 11/1951 | Montgomery | 150/52 |
| 2,683,262 | 7/1954 | Foss | 2/2 |
| 2,712,797 | 7/1955 | Woehrle et al. | 105/367 |
| 2,809,143 | 10/1957 | Rahm | 154/82 |
| 2,861,735 | 11/1958 | Faltin | 229/53 |
| 2,998,340 | 8/1961 | Conway et al. | 154/116 |
| 3,069,978 | 12/1962 | Hoeppner | 93/35 |
| 3,167,209 | 1/1965 | Jones | 220/63 |
| 3,219,240 | 11/1965 | Campbell, Jr. | 222/183 |
| 3,306,328 | 2/1967 | Markus | 150/38 |
| 3,349,991 | 10/1967 | Kessler | 493/194 |
| 3,422,867 | 1/1969 | Wu | 383/66 |
| 3,459,357 | 8/1969 | Egger et al. | 493/96 |
| 3,468,102 | 9/1969 | Farrar et al. | 54/385 |
| 3,481,461 | 12/1969 | Paxton | 383/62 |
| 3,539,360 | 11/1970 | Wood | 493/100 |
| 3,570,751 | 3/1971 | Trewella | 383/66 |
| 3,617,418 | 11/1971 | Miller | 156/227 |
| 3,791,573 | 2/1974 | Titchenal et al. | 229/69 |
| 3,834,528 | 9/1974 | Pickford et al. | 383/10 |
| 3,888,163 | 6/1975 | Watanabe | 493/95 |
| 3,987,959 | 10/1976 | Deards et al. | 93/36.01 |
| 4,285,681 | 8/1981 | Walitalo | 493/194 |
| 4,385,953 | 5/1983 | Beck | 156/200 |
| 4,461,402 | 7/1984 | Fell et al. | 222/105 |
| 4,526,565 | 7/1985 | Hummel | 493/197 |
| 4,570,820 | 2/1986 | Murphy | 383/66 |
| 4,624,654 | 11/1986 | Boyd et al. | 493/194 |
| 4,671,733 | 6/1987 | Krein | 414/786 |
| 4,754,914 | 7/1988 | Wischusen, III | 220/403 |
| 4,759,742 | 7/1988 | Achelpohl | 493/254 |
| 4,840,610 | 6/1989 | Pistner | 493/195 |
| 4,850,508 | 7/1989 | Lee | 220/407 |
| 4,871,046 | 10/1989 | Turner | 383/66 |
| 5,007,744 | 4/1991 | Scarberry et al. | 493/194 |
| 5,041,317 | 8/1991 | Greyvenstein | 383/37 |
| 5,057,065 | 10/1991 | Buchman | 493/194 |
| 5,098,364 | 3/1992 | Schilling | 493/200 |
| 5,110,005 | 5/1992 | Schilling | 220/404 |
| 5,573,489 | 11/1996 | Letendre | 493/194 |

FOREIGN PATENT DOCUMENTS

| | | | |
|---|---|---|---|
| 294087 | 12/1988 | European Pat. Off. | 383/66 |
| 1085853 | 10/1967 | United Kingdom | 220/404 |
| 1551336 | 8/1979 | United Kingdom | 156/204 |

*Primary Examiner*—Jack W. Lavinder
*Attorney, Agent, or Firm*—Pravel, Hewitt, Kimball & Krieger

[57] ABSTRACT

A waste container liner and method of manufacture thereof are provided. The method involves the steps of flattening a continuous tubular web of pliable material to form two adjoining layers of material and then slitting one of the longitudinal edges of the flattened web. The adjoining layers are then sealed at regular intervals across their width and perforations are formed across the seals. The web is twice folded longitudinally prior to rolling and detachment of individual liners along the perforations. The waste container liner is made of a unitary piece of pliable material and includes two adjoining layers joined at a longitudinal edge. Each of the adjoining layers has a free longitudinal edge and is sealed at its lateral edge with the other adjoining layer.

5 Claims, 3 Drawing Sheets

FIG. 10
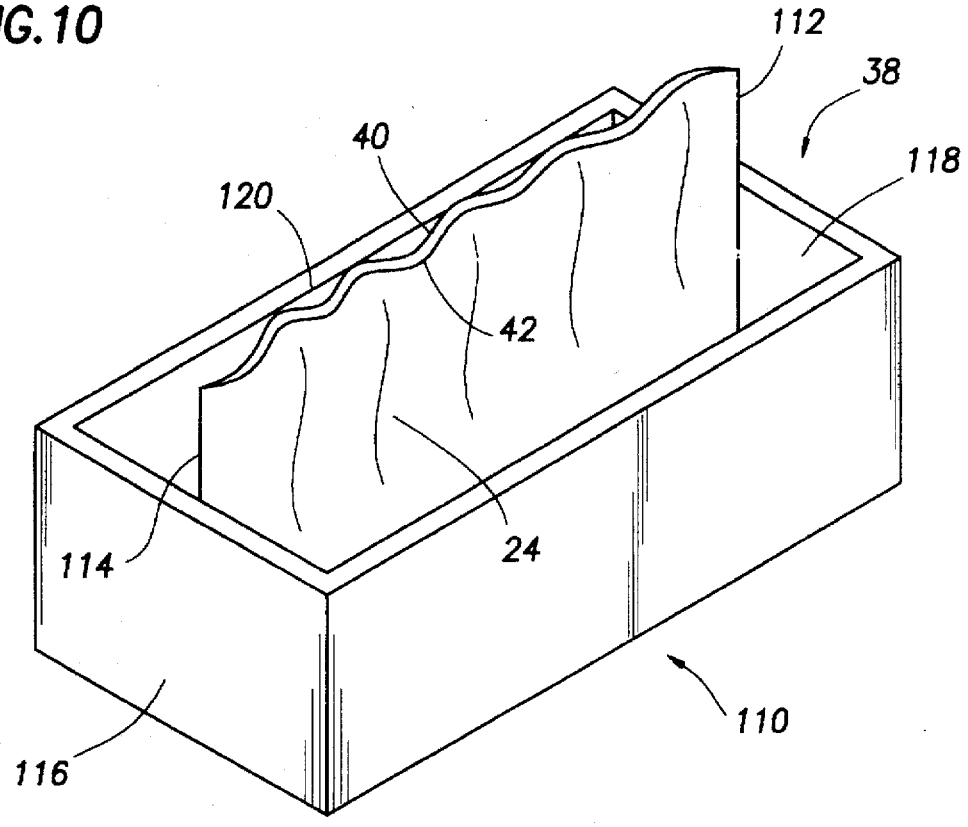
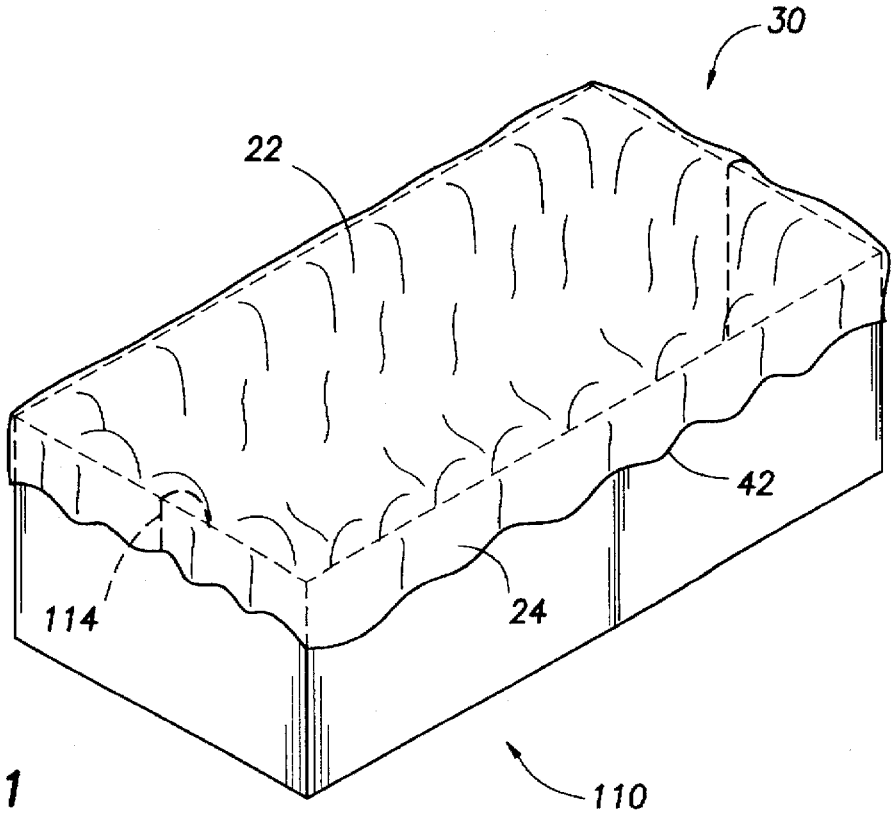
FIG. 11

ENVIRONMENTAL CONTAINER LINER AND METHOD OF MANUFACTURE

BACKGROUND OF THE INVENTION

1. Field of the Invention

This invention relates in general to liners for use in waste containers. More particularly, this invention relates to liners for standardized transportable waste containers and a method for their manufacture.

2. Description of the Related Art

It is common practice for waste material of various types to be stored and transported in large rectangular waste containers of standardized dimensions. Typically these containers are fitted with a removable polymeric waste container liner to prevent leakage of the waste from the container, to preclude contamination of the container by the waste, and to facilitate removal of the waste from the container for disposal.

Typical dimensions for large waste containers, which are often referred to as "dumpsters," are 8 feet in width, 22 feet in length and 43 to 65 inches in depth. The first depth dumpster is often referred to as a "20 $yd^3$" dumpster and the second as a "30 $yd^3$" dumpster. Since waste liners designed to fit these dumpsters are of similar proportions, relatively large, and therefore expensive, floor space must be provided for their manufacture.

The configuration of conventional waste container liners includes multiple folds as well as sealed ends of more than two material layers in thickness. For example, the waste container liner described in U.S. Pat. No. 4,385,953 to Beck requires that the liner material be processed through multiple folding steps in order to provide a sheet of liner material with a "W" cross-section prior to sealing the sheet ends and that a seal which is four material layers in thickness be formed. The production of multiple folds and the sealing of more than two layers of material requires complex and expensive equipment. Moreover, the "W" cross-sectional design of the liner entails a risk that the relatively thick (i.e., four layers) bottom portion of the end seal will not provide the strength required to securely contain waste when the liner is filled.

More recently, a waste container manufacturing method and liner have been described in U.S. Pat. Nos. 5,098,364 and 5,110,005 to Schilling respectively. The method of Schilling, however, involves the repeated handling of a discrete envelope of material, the production of an undesirable number of folds to make a liner with gussetted side panels, and the sealing of four overlapped layers of material.

Still needed in the art is a waste container liner that includes a minimal number of folds and a seal which is of minimal layers in thickness. Also needed is a method of easily and inexpensively manufacturing such a liner without repeated handling of individual discrete envelopes and that may be carried out in a minimum of floor space.

SUMMARY OF THE INVENTION

A method of manufacturing a waste container liner is provided that is more efficient than conventional methods, that utilizes a minimum number of folds prior to the sealing of the liner ends and that requires the provision of a reduced amount of floor space for the folding of the sealed liner.

A waste container liner is produced by first extruding a molten polymer (such as polyethylene) through a die to form a continuous pliable tubular web, then flattening the tubular web such that a flattened web having two adjoining material layers and two longitudinal edges is created. The flattened web is slit along one longitudinal edge to form an opening, and the two adjoining material layers are laterally sealed at regular intervals across the entire width of the flattened web. These seals mark the beginning and the end of individual waste container liners. Perforations are created in the lateral seals for ease of separation of individual liners. The flattened web is folded twice lengthwise along its centerline while the web is moving essentially vertically downward. The twice folded web is rolled longitudinally for packaging and transport.

Also provided is a waste container liner itself that is fabricated of a unitary piece of pliable material. The unitary liner has a single folded longitudinal edge, two adjoining layers, two sealed lateral edges and two free longitudinal edges opposite the folded edge. These two free longitudinal edges define an opening of the waste container liner. The adjoining layers are contiguous at the single folded edge and each of the two adjoining layers includes one of the free longitudinal edges. The two adjoining layers are sealed together at their lateral edges to define a discrete liner. Since only two layers of material are being sealed at their edges, a consistently stronger seal, in comparison to seals of more than two material layers in thickness, is provided.

BRIEF DESCRIPTION OF THE DRAWINGS

A better understanding of the present invention can be obtained when the following detailed description of the preferred embodiment is considered in conjunction with the following drawings, in which:

FIG. 10 is a perspective view of an embodiment of the inventive liner unrolled, unfolded and placed in a waste container.

FIG. 11 is a is a perspective view of an embodiment of the inventive liner installed in a waste container.

DETAILED DESCRIPTION OF THE PREFERRED EMBODIMENT

Figure 8:
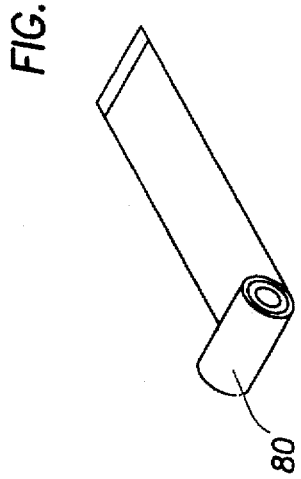
FIG. 8 is a perspective view of a portion of a twice-folded web undergoing a longitudinal rolling step of the manufacturing process of the invention.
Figure 9:
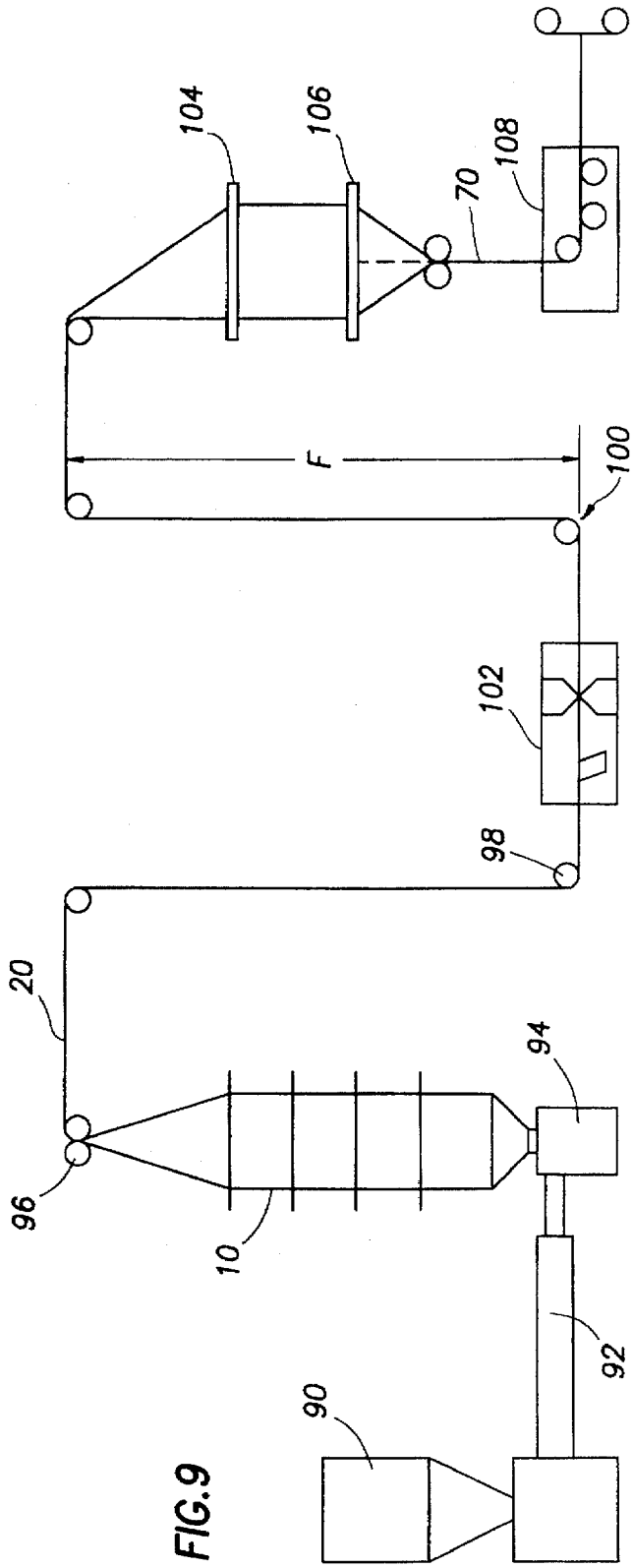
FIG. 9 is a diagrammatic illustration of an apparatus for carrying out the method of the invention.

Turning now to the drawings, FIGS. 1–9 schematically illustrate a preferred method of manufacturing the waste container liner according to the invention. It is to be understood, unless otherwise noted, that the steps of the method are performed on a continuous web, as illustrated in FIG. 9. However, for the sake of clarity, only a discrete portion of the continuous web is illustrated in FIGS. 1–8.

Figure 1:
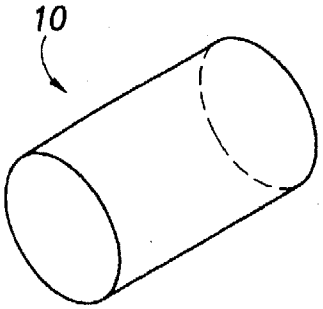
FIG. 1 is a perspective view of a portion of an extruded continuous tubular polymeric web that is employed in a step of the manufacturing process of the invention.

As shown in FIGS. 1 and 9, a continuous tubular web 10 of flexible liner material is provided. It is preferred that the circumference of the tubular web be equal to at least the width plus twice the height of the container, in which the liner is to be positioned, plus twice a desired liner overhang. For a standardized container that is 22 feet in length, 8 feet in width and 43 inches high, with a desired overhang of about 1 foot on each edge of the container, the preferred circumference of the tubular web is about 17 feet and 2 inches. Similarly, if the height of the dumpster were alternatively 63 inches, with all other dumpster dimensions the unchanged, the preferred circumference of the tubular web is about 20 feet and 6 inches.

The liner material, while typically polyethylene, may be of any pliable material that is suitable for the type of waste to be contained. The thickness of the liner material must be sufficient to provide the required strength to withstand the stresses present when the liner is filled with waste. A typical thickness for a polyethylene liner for the standard sized dumpsters described above is 4 mm.

Conventional methods, such as those described in U.S. Pat. No. 4,624,654 to Boyd et al. and incorporated herein by reference as if fully set forth, can be employed to produce the tubular web 10. Referring, however, to FIG. 9 for a schematic representation of a preferred method, plastic feed stock (not shown) is placed into hopper 90, heated and forced through extruder assembly 92 and circular die 94 to form tubular web 10.

Figure 2:
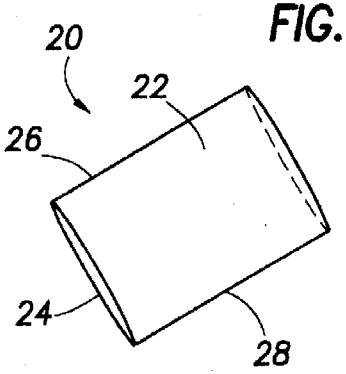
FIG. 2 is a perspective view of a portion of a flattened continuous polymeric web that is employed in a step of the manufacturing process of the invention.

As shown in FIGS. 2 and 9, the advancing front of the extruded continuous tubular web is flattened by upper roller apparatus 96 (alternatively referred to as upper nipps) to produce a flattened web 20 having two adjoining liner material layers 22, 24 and two longitudinal edges 26 and 28. The width of the flattened web is essentially one half of the tubular web circumference. For a standard sized waste container the flattened web width is about 8 feet and 7 inches.

Figure 3:
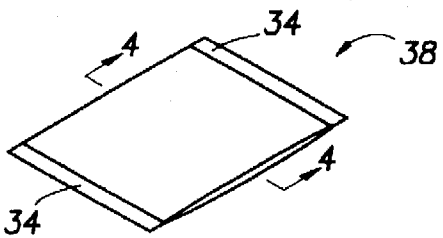
FIG. 3 is a is a perspective view of a portion of a flattened continuous polymeric web employed in a step of the manufacturing process of the invention that has been slit along a longitudinal edge and transversely sealed.
Figure 4:
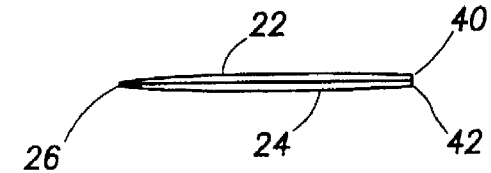
FIG. 4 is a diagrammatic transverse sectional taken view along line 4—4 of FIG. 3.
Figure 5:
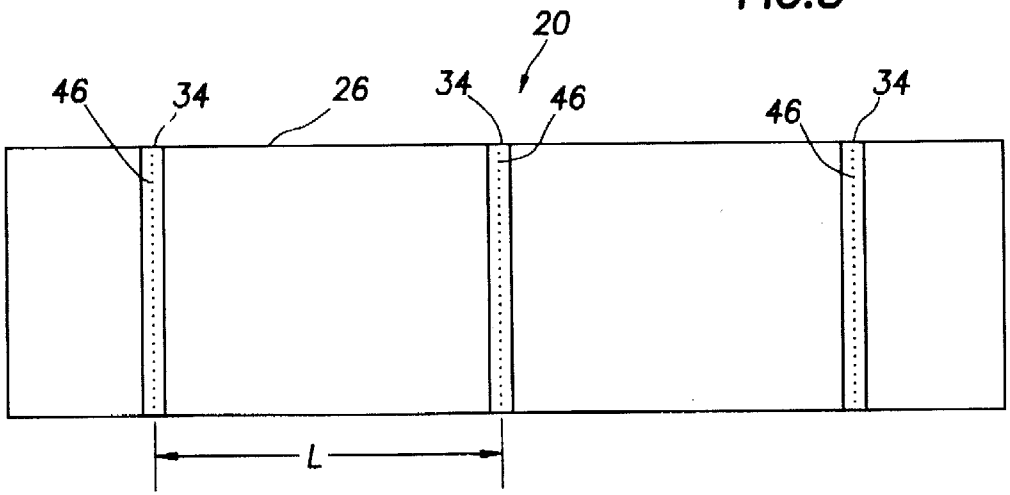
FIG. 5 is a diagrammatic top view of a portion of a flattened continuous polymeric web that has been transversely sealed at regular intervals and perforated across the width of the seals.

Turning now to FIGS. 3 through 5, the advancing flattened web 20 is slit along longitudinal edge 28 to form two free longitudinal edges 40 and 42, as illustrated in FIG. 4. The two adjoining material layers are then sealed to each other, across the entire width of the flattened web, at regular intervals of distance L to form lateral seals 34 (as shown in FIGS. 3 and 5). The seals can be formed by any conventional means including heat sealing. Since only two layers of liner material, and therefore a thickness of only two times the material thickness, must be heated and bonded to produce the lateral seals 34, the strength of the seal is improved in comparison to seals made up of more than two layers of material.

The interval distance L, indicated in FIG. 5, determines the length of an individual waste container liner. The interval distance L is equal to at least the length plus twice the height of the container, in which the liner is to be positioned, plus twice a desired liner overhang. For a standardized waste container with a length of 22 feet, a height of 43 inches and a desired overhand of about 1 foot on each edge of the container, an interval L of about 32 feet, and therefore an individual liner length also of about 32 feet, is preferred.

After lateral seals 34 have been formed, a line of perforations 46 is then provided in the lateral seals. The line of perforations 46 extends across the width of the web to provide a means for tearing individual liners 38 from the continuous web at a later time.

The flattening, slitting, sealing and perforating steps can be performed on conventional equipment that is well known in the art. Suitable equipment for the flattening, slitting and sealing process steps is described in, for example, U.S. Pat. No. 4,624,654. Referring again, however, to FIG. 9 for a schematic representation of a preferred method, flattened tubular web 20 is advanced by a pair of lower roller assemblies 98, 100 through bag assembly 102 for sequential slitting, sealing and perforating.

Figure 7:
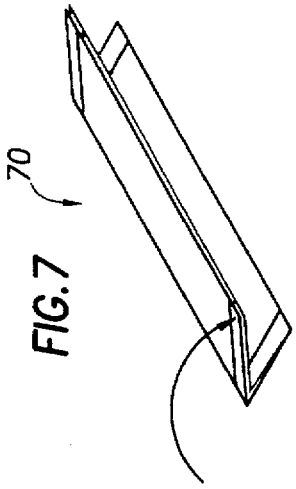
FIG. 7 is a perspective view of a portion of a once-folded continuous web undergoing a second folding step of the manufacturing process of the invention.
Figure 6:
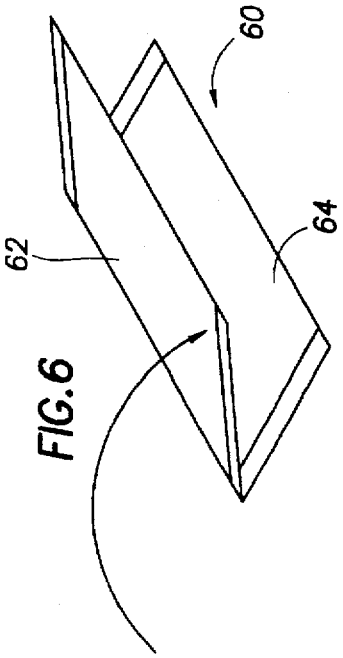
FIG. 6 is a perspective view of a portion of a continuous web undergoing a folding step of the manufacturing process of the invention.

Once the perforations are formed, the web is raised to a predetermined height F in preparation for folding (as shown in FIG. 9). Once the web had been raised to height F, the web is folded lengthwise down its centerline, while moving vertically downward through first folder 104, to form a once-folded web 60 with equal sized halves 62 and 64 as illustrated in FIGS. 6 and 9. The once-folded web is then folded a second time, while moving vertically downward through second folder 106, to form twice folded web 70, as illustrated in FIG. 7 and 9. By performing the folding steps of the method while the web is moving essentially vertically, less floor space, as compared to conventional folding operations that are performed horizontally, is required. The decreased floor space requirements results in a less expensive manufacturing process.

The twice folded web is then rolled up longitudinally by winder 108 to form folded liner roll 80, as illustrated in FIGS. 8 and 9. If desired, each individual liner 38 may be separated from the continuous web by tearing along perforations 46 prior to or during rolling in order to provide an individual folded and rolled liner. As a liner is torn from a web along perforations 46, lateral seals 34 are divided down their centerline producing a liner 38 with sealed lateral edges 112 and 114 (as shown in FIGS. 10 and 11).

Alternatively, the folded web can be rolled into bundles containing a plurality of liners connected by seals 34 and the plurality of connected liners only torn from the continuous web once the desired number of liners have been rolled into a bundle. If desired, liners can be separated at the perforations prior to the first folding step to form individual unfolded and unrolled liners.

Referring to FIG. 10, liner 38 is shown unrolled and placed in waste container 110 such that folded longitudinal edge 26 (not visible in FIG. 10) is placed on the bottom of the container, sealed lateral edges 112 and 114 of liner 38 extend from the bottom of the container up along container ends 116 and 118, while free longitudinal edges 40 and 42 are positioned above upper container edge 120. Once liner 38 is placed in container 110, adjoining material layers 22 and 24 are pulled apart and spread across the bottom of the container, up along the container sides and ends, and hung over container edge 120, as shown in FIG. 11.

The foregoing description of the invention is illustrative and explanatory thereof. Various changes in the materials, apparatus, and particular steps employed will occur to those skilled in the art. For example, the order of slitting, sealing and perforating the web may be changed or the number of lengthwise folds of the sealed web increased or decreased. It is intended that all such variations within the scope and spirit of the appended claims be embraced thereby.

What is claimed is:

1. A method of producing a waste container liner, comprising the steps of:

(a) providing a continuous tubular web of pliable material;

(b) flattening the tubular web to form a flattened web of two adjoining material layers, the flattened web having two longitudinal edges;

(c) slitting the flattened web along one longitudinal edge;

(d) sealing the two adjoining material layers at regular intervals across the entire width of the flattened web to form lateral seals;

(e) providing perforations in the lateral seals across the width of the flattened web;

(f) folding the flattened web substantially along the web centerline to form a once-folded web, the folding of the flattened web occurring as the web is moving essentially vertically downward;

(g) folding the once-folded web substantially along its centerline to form a twice-folded web, the folding of the once-folded web occurring as the web is moving essentially vertically downward; and (h) rolling up the twice folded web longitudinally to form a folded and rolled liner.

2. The method of claim 1, wherein steps (c) and (d) are performed near the ground, the method further comprising:

(i) before step (f) and after steps (c) and (d) raising the flattened web vertically above ground level.

3. The method of claim 1, wherein said tubular web is about 17 feet 2 inches in circumference.

4. The method of claim 1,wherein said tubular web is about 20 feet 6 inches in circumference.

5. The method of claim 1, wherein step (e) further comprises the step of:

providing two sets of perforation spaced about 32 feet apart.

* * * * *